US007677781B2

(12) United States Patent
Ishihara et al.

(10) Patent No.: US 7,677,781 B2
(45) Date of Patent: Mar. 16, 2010

(54) SHEET SWITCH MODULE

(75) Inventors: Kazuya Ishihara, Tsuru (JP); Kosuke Tsuchiya, Fujiyoshida (JP); Akira Watanabe, Fujiyoshida (JP)

(73) Assignees: Citizen Electronics Co., Ltd., Yamanashi (JP); Fuji Polymer Industries Co., Ltd., Aichi (JP)

( * ) Notice: Subject to any disclaimer, the term of this patent is extended or adjusted under 35 U.S.C. 154(b) by 112 days.

(21) Appl. No.: 11/758,191

(22) Filed: Jun. 5, 2007

(65) Prior Publication Data

US 2007/0279932 A1 Dec. 6, 2007

(30) Foreign Application Priority Data

Jun. 5, 2006 (JP) ..... 2006-156525

(51) Int. Cl.
*F21V 7/04* (2006.01)

(52) U.S. Cl. ..... 362/602; 362/26; 362/551; 200/310

(58) Field of Classification Search ..... 362/600–634, 362/551–582, 23–30; 200/310–317, 60; 379/368

See application file for complete search history.

(56) References Cited

U.S. PATENT DOCUMENTS

| | | | | |
|---|---|---|---|---|
| 6,247,826 | B1 | 6/2001 | Funamoto et al. | |
| 6,926,418 | B2 * | 8/2005 | Ostergård et al. | 362/24 |
| 2004/0130912 | A1 | 7/2004 | Miyashita | |
| 2007/0242445 | A1 * | 10/2007 | Shin et al. | 362/24 |
| 2008/0144333 | A1 * | 6/2008 | Gourlay | 362/609 |

FOREIGN PATENT DOCUMENTS

| | | |
|---|---|---|
| JP | 2001167655 | 6/2001 |

* cited by examiner

*Primary Examiner*—Bao Q Truong
(74) *Attorney, Agent, or Firm*—Browdy and Neimark, PLLC

(57) ABSTRACT

A sheet switch module including a circuit board (22), at least one key switch (25) disposed on the circuit board, and a flexible light guiding sheet (31) which is disposed on the key switch and configured to cover the circuit board, the light guiding sheet being configured to flexibly fit over and follow the shape of the key switch along an outer surface of the key switch, when the light guiding sheet is disposed on the circuit board.

13 Claims, 7 Drawing Sheets

SHEET SWITCH MODULE

CROSS-REFERENCE TO THE RELATED APPLICATION

This application is based on and claims priority from Japanese Patent Application No. 2006-156525, filed Jun. 5, 2006, the disclosure of which is incorporated herein by reference in its entirety.

BACKGROUND OF THE INVENTION

1. Field of the Invention

The present invention relates to a sheet switch module which is installed in switch panels of mobile phones, mobile terminal devices, or the like.

2. Description of Related Art

A sheet switch 10 as shown in FIG. 7 has conventionally been used in a key input part of various kinds of electronic equipment, such as mobile phones, mobile terminal devices, or the like. Each of a number of sheet switches has an illumination function including key switches 8 and light sources or light emitting elements 6 each of which is disposed about each of the key switches 8.

On the other hand, FIG. 8 illustrates a sectional structure of a conventional sheet switch 1 including one or more light emitting elements 6 and a flat plate-shaped light guiding plate 5 (for reference, see Japanese Patent Application Publication No. 2004-69751, FIG. 9). The sheet switch 1 further includes a circuit board 2 provided with fixed contacts 3 and wiring patterns, movable contacts 4 each of which is disposed on the circuit board 2 to cover each of the fixed contacts 3 and includes a tact spring, and key tops 7 to press the movable contacts 4. The light guiding plate 5 is disposed over the circuit board 2. The light emitting elements 6 illuminate one side surface of the light guiding plate 5. Each of the key tops 7 has a lower portion which passes through the light guiding plate 5 and faces the corresponding movable contact 4. In the sheet switch 1, the entirety of the key tops 7 can be illuminated by guiding light emitted from the light emitting elements 6 to the lower portion of each of the key tops 7 passing through the light guiding plate 5.

Also known is an even thinner sheet switch together with an illumination function which has been a response to the recent trend towards thinning of electronic instruments (for reference, see Japanese Patent Application Publication No. 2004-69751, FIGS. 6 and 9). FIG. 9 illustrates a sectional structure of the sheet switch 11 mentioned in Japanese Patent Application Publication No. 2004-69751. The sheet switch 11 includes a circuit board 12, a sheet switch part 18 which is provided on the circuit board 12 and comprises a plurality of fixed contacts 13 and a plurality of movable contacts 14 each of which is disposed to cover each of the fixed contacts, a light guiding plate 15 disposed over the sheet switch part 18, key tops 17 disposed above the light guiding plate 15 to face the movable contacts 14 and one or more light emitting elements 16 disposed on one end portion of the circuit board 12. In the sheet switch 11, light emitted from the light emitting elements 16 enters a side surface of the light guiding plate 15, thereby the entire light guiding plate 15 is lighted up to illuminate the key tops 17 from below.

However, in the sheet switch 10 in which the light emitting elements 6 are disposed in the vicinity of the key switches 8, as shown in FIG. 7, because additional light emitting elements 6 must be provided as the number of key switches 8 increases, there arises a problem that both power consumption and the overall size of the sheet switch 10 are increased.

Moreover, in the sheet switch 1 as shown in FIG. 8, because the light emitted from the light emitting elements 6 is directed to the key tops 7 through the light guiding plate 5, it is sufficient to use a small number of light emitting elements 6, but a light guiding plate 5 having a greater than usual thickness must be used to guide light emitted from the light emitting elements 6 efficiently without leaking. Using a thick light guiding plate 5 causes an increase in the thickness of the entire sheet switch 1, therefore making it difficult to achieve a thin sheet switch.

On the other hand, in the sheet switch 11 as shown in FIG. 9, because the light emitted from the light emitting elements 16 enters the light guiding plate 15 by passing through one end thereof and is guided throughout the entire light guiding plate 16, a brightness of the key tops 17 remote from the light emitting elements 16 is reduced, giving rise to a problem that overall variations in brightness stand out. Because the light guiding plate 15 is formed by acrylic resin or the bike in a planate state and merely placed on the sheet switch part 18, a large clearance tends to occur between the light guiding plate 15 and the sheet switch part 18, or even between the light guiding plate 15 and each of the light emitting elements 16. The large clearance in the vicinity of the light guiding plate 15 causes a light leak through the large clearance, and problems occur that an amount of the light guided to the key tops 17 is deficient or that there are variations in brightness.

Also, in the sheet switch 11, when the key tops 17 are clicked, because the movable contacts 14 are moved through the light guiding plate 15, if the light guiding plate 15 is formed by a hard resinous material, the clicking sensation is lost, and the switching characteristic is adversely affected.

SUMMARY OF THE INVENTION

An object of the present invention is to provide a sheet switch module capable of evenly guiding light which enters an end portion of a flexible light guiding sheet to a key switch provided on a circuit board, and which has an improved switching characteristic and an overall thinned structure, by placing the light guiding sheet on the key switch to adapt flexibly to the key switch.

To accomplish the above object, a sheet switch module according to one embodiment of the present invention includes a circuit board, at least one key switch disposed on the circuit board, and a flexible light guiding sheet which is disposed on the key switch and configured to cover the circuit board.

The light guiding sheet is disposed on the key switch and its weight causes it to adapt flexibly to an outer surface of the key switch, when the light guiding sheet is disposed on the circuit board.

DETAILED DESCRIPTION OF THE PREFERRED EMBODIMENTS

Preferred embodiments of the present invention will be explained in detail with reference to the accompanying drawings below.

Figure 1:
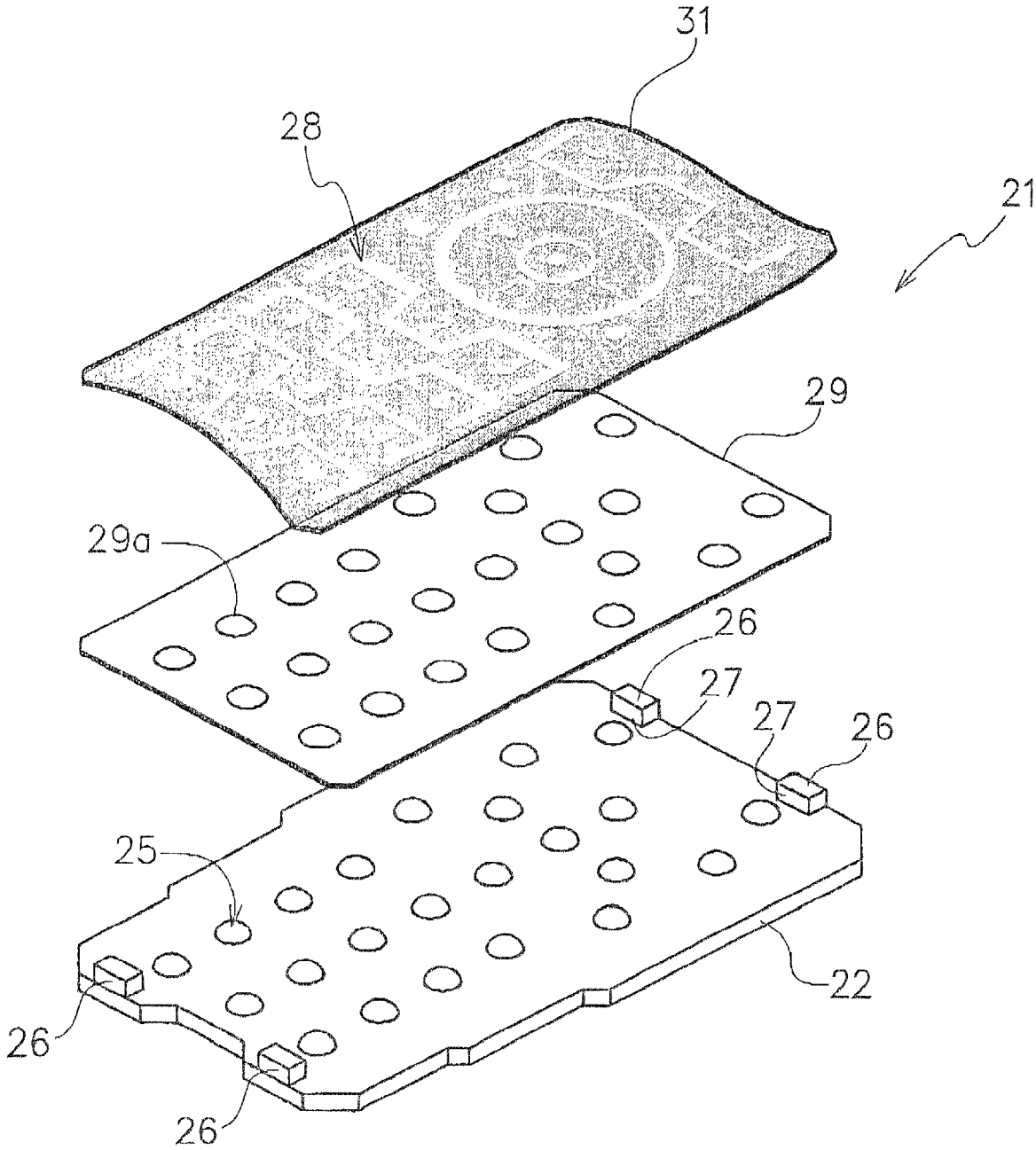
FIG. 1 is an exploded perspective view showing one embodiment of a sheet switch module according to the present invention.

FIG. 1 shows a sheet switch module 21 according to the present invention. The sheet switch module 21 includes a circuit board 22, a fixing sheet 29 disposed on the circuit board 22, and a light guiding sheet 31 disposed on the fixing sheet 29.

The circuit board 22, the fixing sheet 29 and the light guiding sheet 31 are of substantially similar shape and size.

The circuit board 22 has, for example, a generally rectangular shape. It is preferable that the circuit board 22 is relatively thin so as to reduce the entire thickness of the sheet switch module, and at least one key switch is provided on the circuit board 22. In the embodiment, a plurality of key switches 25 are provided on a surface, for example, an upper surface of the circuit board 22 (see FIG. 1). Each of the plurality of key switches 25 comprises, for example, a convex portion, more specifically, a generally semi-spherical protrusion. Alternatively, one key switch may be provided on the circuit board 92.

At least one light emitting diode (LED) 26 is provided to illuminate the light guiding sheet 31. In the embodiment, a plurality of LEDs 26 each of which is a side emission type are provided on the upper surface of the circuit board 22. The LEDs 26 are disposed at, for example, opposite fringes of the circuit board 22 (see FIG. 1).

The fixing sheet 29 has a plurality of concave portions 29*a* each of which is disposed corresponding to each of the key switches 25 on the circuit board 22. A size of each of the concave portions 29*a* is set so that the semi-spherical key switches 25 can be smoothly inserted in the concave portions 29*a*. The fixing sheet 29 is disposed to cover the upper surface of the circuit board 22 in close contact with each of the key switches and the light guiding sheet 31 is disposed on the fixing sheet 29 to cover the entire fixing sheet. In this case, the fixing sheet 29 is disposed on the circuit board 22 so that the key switches 25 are inserted in the concave portions 29*a*.

The circuit board 22 comprises a resinous plate made of glass epoxy or the like or a bendable flexible print circuit board (FPC). Electrode sections and wiring patterns extending from the electrode sections for mounting of the key switches 25 and the LEDs 26 on the circuit board 22 are formed on the upper surface of the circuit board 22.

Figure 3:
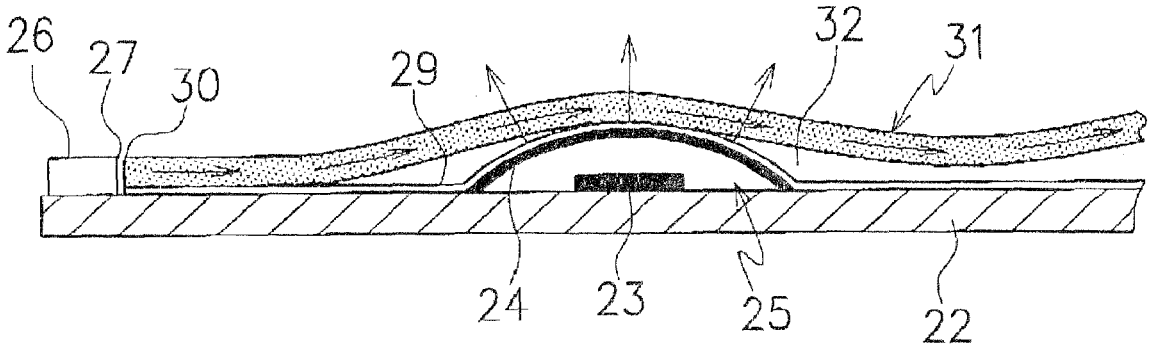
FIG. 3 is a sectional view showing a main part of the sheet switch module shown in FIG. 1.
Figure 4:
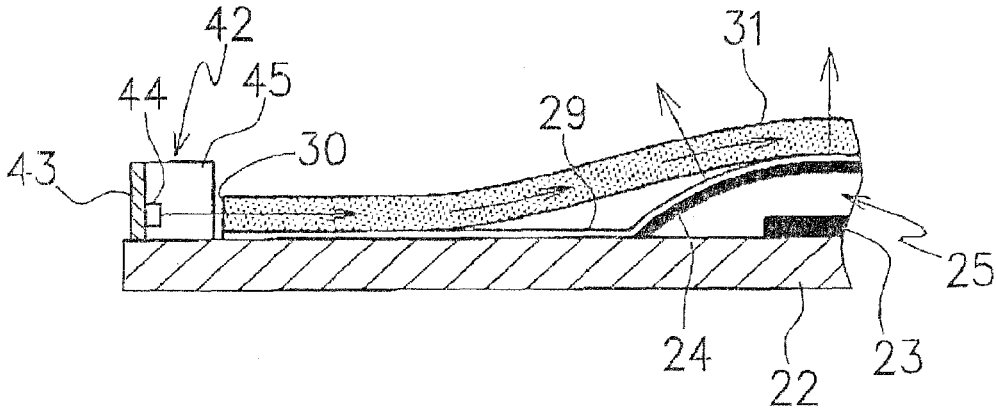
FIG. 4 is a sectional view showing a relationship between an LED and a light guiding sheet provided in the sheet switch module shown in FIG. 1.

Each of the key switches 25 includes a fixed contact 23 arranged on the circuit board 22 and a movable contact 24 which is disposed to cover above the fixed contact 23 without making contact with the fixed contact and comprises a semi-spherical tact spring or the like. Each of the LEDs 26 has at a lower surface thereof a pair of element electrode parts comprising an anode and a cathode, which are electrically connected to the above-mentioned electrode sections formed on the circuit board 22 and one side surface or emission surface 27 disposed to face one end surface of the light guiding sheet 31. Thereby, light emitted from the LEDs 26 enters the one end surface of the light guiding sheet 31 and is guided through the light guiding sheet 31 (see FIGS. 3 and 4).

The fixing sheet 29 which is formed by a relatively thin sheet of a white color or metal color type to reflect light, is disposed to be in close contact with the key switches 25 and the circuit board 22 to cover other surfaces of the key switches 25. The fixing sheet 29 which fixes the key switches 25 on the circuit board 22 and further enhances the illumination effects on the key switches 25 by efficiently reflecting light in an upward direction.

Meanwhile, the fixing sheet 29 allows the key switches 25 to be accurately positioned on the circuit board 22 because each of the key switches 25 is adapted to each of the concave portions 29*a*.

Figure 2:
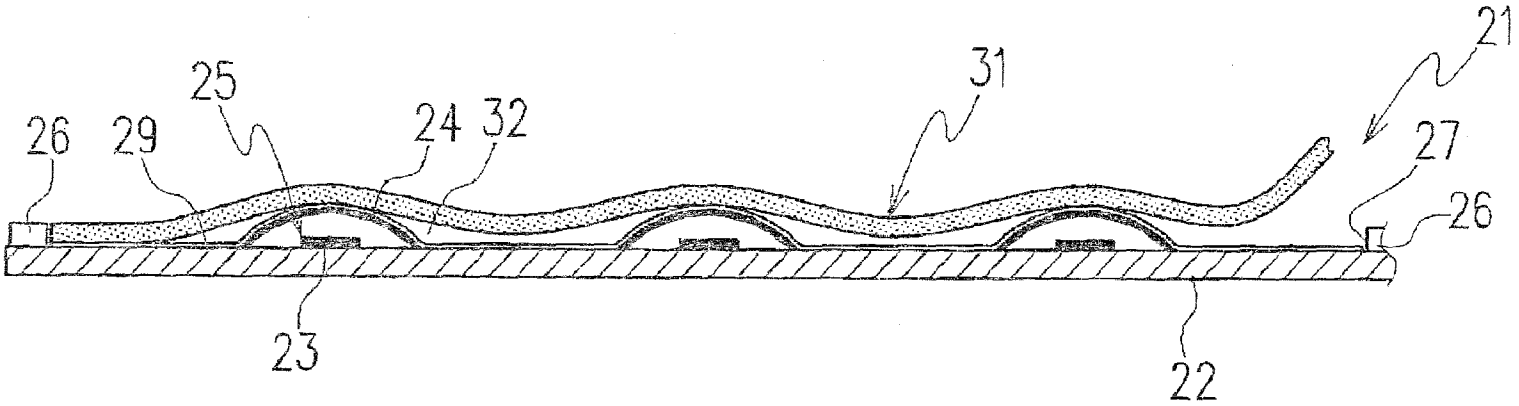
FIG. 2 is a sectional view of the sheet switch module shown in FIG. 1.

The light guiding sheet 31 has a thickness which is less than or equal to a height of each of the LEDs 26 disposed on the circuit board 22 and is preferably formed by a silicone sheet. The light guiding sheet 31 formed by such a silicone sheet intrinsically possesses a suitable surface viscosity and a property that it flexibly deforms under its own weight even at a normal temperature. Accordingly, the light guiding sheet 31 makes smooth contact with portions of the fixing sheet 29 facing the top portion of each of the key switches 25 merely by placing the light guiding sheet 31 on the fixing sheet 29, as shown in FIG. 2, and can be disposed on the fixing sheet 29 to adapt naturally and flexibly to the portions of the fixing sheet 29 facing the key switches 25. In this way, because the light guiding sheet 31 does not make complete contact with each of the key switches 25 at a fringe portion and is in a state such that there is a clearance 32 in an outer peripheral portion of each of the key switches the fixing sheet 29 facing each of they switches 25, no large bent portion occurs in the light guiding sheet 31.

Consequently, because the light guiding sheet 31 can be disposed so that it is held to some extent in a parallel state with respect to the circuit board 22, the light guiding sheet makes it possible to smoothly guide the light emitted from the LEDs 26 disposed at the opposite fringe portions on the circuit board 22 without overall variations. In addition, the light emitted from the LEDs 26 can reach the corners of the light guiding sheet 31, because an air layer generated by the clearance 32 between the portion of the fixing sheet 29 facing each of the key switches 25 and the light guiding sheet 31 operates to allow full reflection.

The light guiding sheet 31 is transparent or translucent for transmitting light. In this case, a function of the key switches 25 can be directly displayed by providing printed sections 28 such as numbers, marks, lines for display or the like, for example, portions of the light guiding sheet 31 corresponding to the key switches 25. When the printed sections 28 are printed by a white color type coating material and light emitted from the LEDs 26 is introduced into the light emitting sheet 31, reflection of the light on the key switches 25 makes it possible to achieve visual effects in which the printed sections 28 of the white color type stand out faintly.

As shown in FIG. 1, by forming the printed sections 28 so that a printed width of each of the printed sections gradually increases from the opposite ends of the light guiding sheet 31 to a central portion thereof, it is possible to increase a reflectance ratio on the printed sections 28 with distance from the LEDs 26. In other words, the aforementioned arrangement of the printed sections 28 enables to supplement luminance of lights which tends to attenuate around a central area of the light guiding sheet 31, and also enables to restrain illuminating variations depending on the position of each of the key switches 25

In addition, at least one kind of powdered light-diffusing agent or filler is mixed in a coating material that is used for forming the printed sections 28. The powdered light-diffusing agent is made from titanic oxide, silicon dioxide, aluminum oxide or the like. It may be possible to increase light reflection efficiency by increasing the proportion of the light-diffusing agent around the central area of the light guiding sheet 31. Thus, such arrangement enables to restrain luminance attenuation from occurring in the light guiding sheet 31 with distance from LEDs 26. The powdered light-diffusing agent or filler may be mixed only in the coating material, and the coating material mixed with the light-diffusing agent or filler may be just printed on the light guiding sheet 31. Instead of printing, the printed sections 28 may be formed by double shot molding or the like.

Also, instead of white color type coating material, fluorescent materials and pigments may be used for the printed sections 28, resulting in acquiring different illuminating effects. Furthermore, prisms and tuberositas may be disposed on a surface of light guiding sheet in accordance with the printed sections 28, resulting in acquiring a light diffusing effect.

In the sheet switch module 21, the light emitted from the emission surface 27 of each of the LEDs 26 is emitted in a direction parallel to the circuit board 22 and directly enters an incident surface 30 of the light guiding sheet 31. The light entering the incident surface 30 is guided along an upper surface of the circuit board 22 and along the movable contact 24 of each of the key switches 25 through the flexibly undulating light guiding sheet 29 along the circuit board 22 and the key switches 25. By reflecting the light on a contact portion of the fixing sheet 29 and the light guiding sheet 31, the light guiding sheet 31 can be brightly illuminated by the reflected light so that the key switches 25 stand out from the surface of the light guiding sheet 31. If the printed sections 28 are formed on a back surface of the light guiding sheet 31, visibility on the printed sections 28 can be enhanced by reflecting light through the printed sections 28. In addition, because the light guiding sheet 31 can naturally cover the key switches 25, fitting over and following the shape of each of the key switches 25 under its own weight, an overall thinned sheet switch module 21 can be achieved at a cheap manufacturing cost.

The light guiding sheet 31 has an end portion which is configured to be adapted to a height of each of the LEDs 26, or its thickness is configured to be adapted to the height of each of the LEDs 26, thereby the light emitted from the LEDs 26 enables to efficiently enter the light guiding sheet 31. Also, as with one or more LEDs 42 shown in FIG. 4, deviation of a mounting position of a light emitting element 44 from a central portion of an element substrate 43 to a lower side thereof, makes it possible for the light to efficiently enter a generally intermediate portion of the thickness of the light guiding sheet 31 corresponding to a thinned type.

In addition, the light emitted from the light emitting elements 44 can be efficiently entered the incident surface 30 of the light guiding sheet 31 without leaking the light circumferentially by covering a light-transmitting sealing resin 46 by means of a light shielding member at a portion other than a place of each LED 42 facing the end portion of the light guiding sheet 31.

Moreover, when the circuit board 22 is formed by the FPC and the light guiding sheet 31 covers an upper surface of the circuit board 22, depending on deformation of the FPC, the light guiding sheet 31 is also deformed to fit over and follow the shape of the key switches 25. Consequently, it is possible to mount the light guiding sheet 31 on an operation panel or exterior surface of an electronic instrument having a concave shape or convex shape, without generating an unneeded clearance.

Meanwhile, in the above-mentioned embodiment, a silicon sheet has been used for the light guiding sheet 31, but it is also possible to use an acryl sheet or polycarbonate sheet or the like having similar light guiding properties and flexibility. If all acryl sheet or polycarbonate sheet or the like is used, the sheet must be formed thinner than the silicone sheet to obtain the same flexibility.

Figure 5:
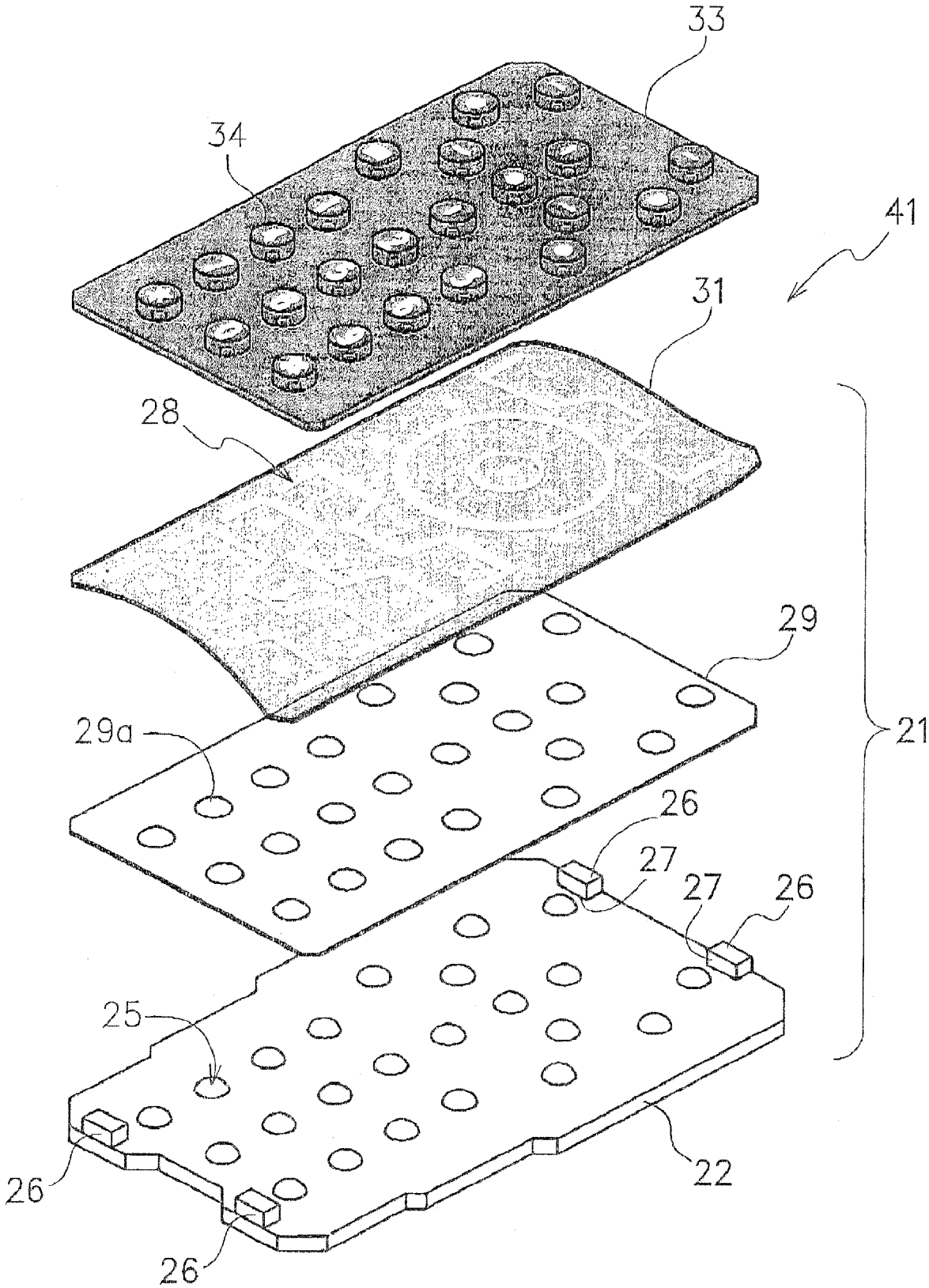
FIG. 5 is an exploded perspective view of a switch panel assembled with the sheet switch module and a key top sheet.
Figure 6:
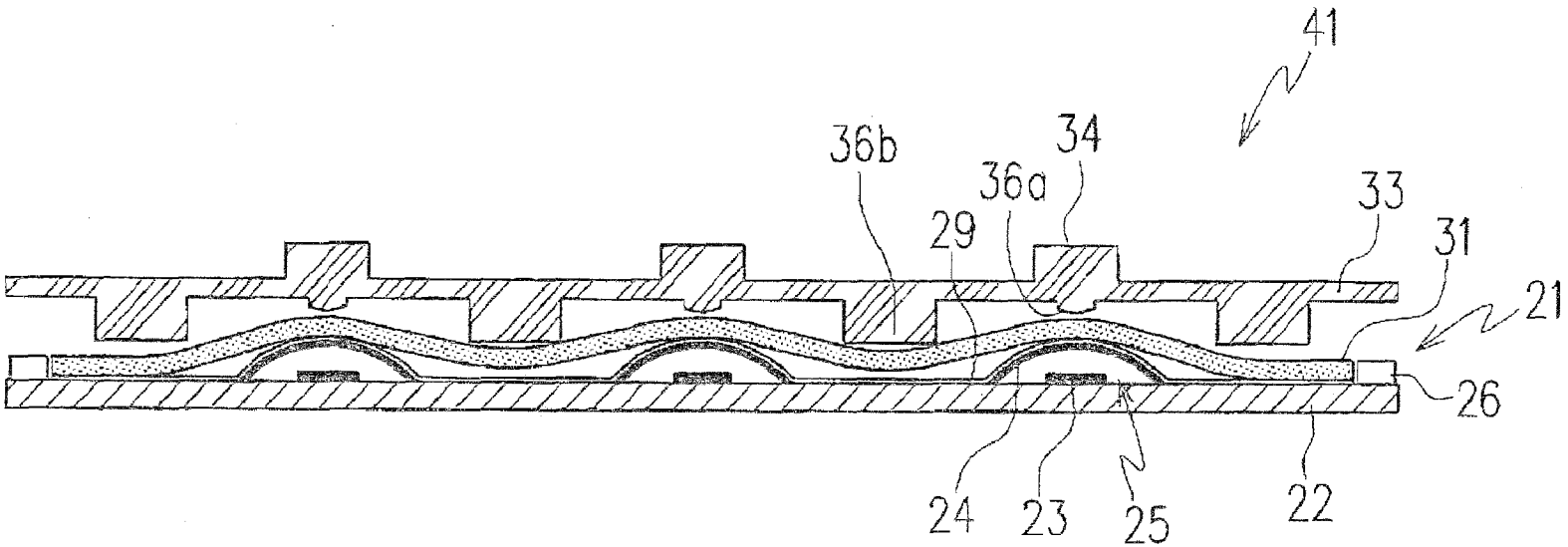
FIG. 6 is a sectional view of the switch panel as shown in FIG. 5.
Figure 7:
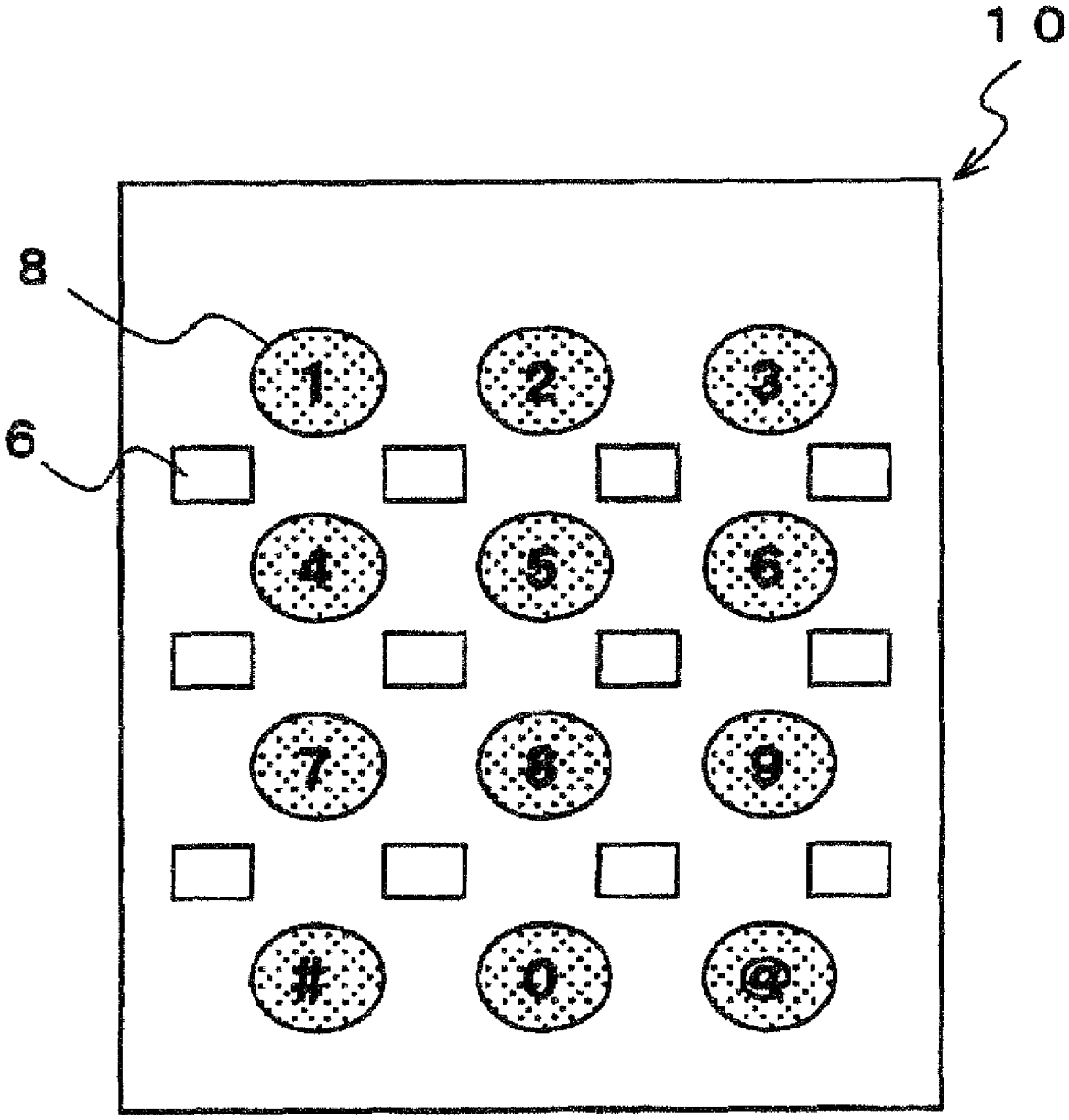
Fig. 7 (Prior Art)
FIG. 7 is a plan view of a conventional sheet switch module in which a plurality of light sources are disposed.
Figure 8:
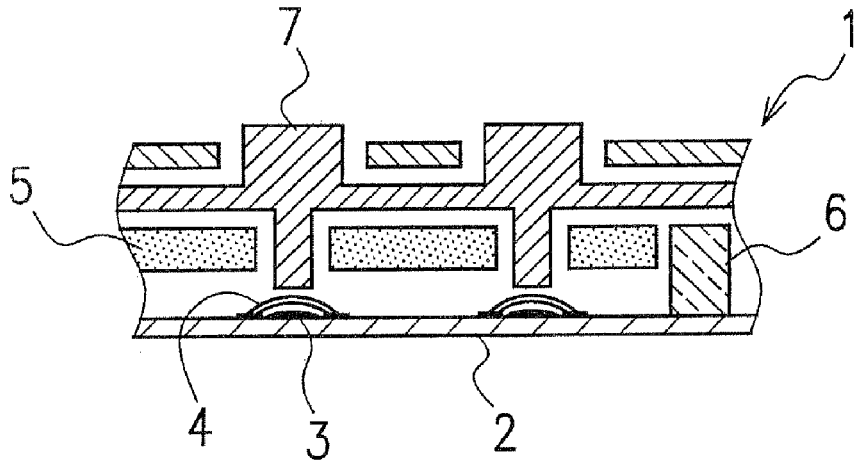
Fig. 8 (Prior Art)
FIG. 8 is a sectional view of another conventional sheet switch module including a plurality of light sources and a light guiding plate.
Figure 9:
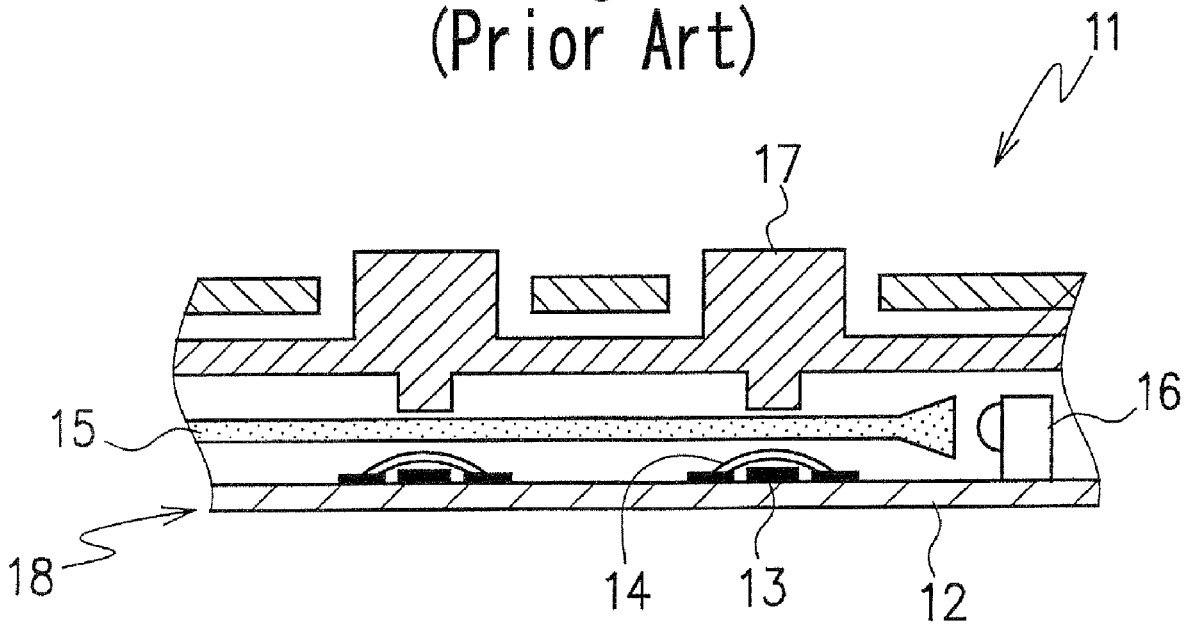
Fig. 9 (Prior Art)
FIG. 9 is a sectional view of further conventional sheet switch module, with one light source disposed to face a side of the light guiding plate.

FIGS. 5 and 6 illustrate a switch panel 41 including the sheet switch module 21. The switch panel 41 includes a key top sheet 33 disposed on the sheet switch module 21. The switch panel 41 can be mounted directly on an operational panel of each of various electronic instruments.

The key top sheet 33 is formed by a sheet-shaped resinous material of polyimide, polycarbonate or the like or by a soft resinous material such as a thin silicon rubber or the like. Portions of key top sheet 33 corresponding to the movable contacts are increased in thickness as key tops 34. Each of the key tops 34 may be transparent or semi-transparent and have at a top surface thereof a numeric character, mark, print, stamp or the like which shows the input function of each key switches 25.

In the switch panel 41, light emitted from the emission surface 27 of each LED 26 directly enters the incident surface 30 of the light guiding sheet 31 and is guided along the key switches 25. The guided light is upwardly reflected on the movable contacts 24 of the key switches 25 passing through the fixing sheet 29. The key tops 34 are illuminated by the reflected light. In the switch panel 41, the light guiding sheet 31 is disposed between the key top sheet 33 and the circuit board 22 in a state such that a small space is provided about each of the key switches 25 by protrusions **36*a* and 36*b* provided on a back surface of the key top sheet 33. By pressing each of the key tops 34, the movable contact 24 is flexed downwardly and makes contact with the fixed contact 23 so that electric conduction occurs between the movable and fixed contacts. In addition, when a finger of a user is disengaged from the pressed key top 34, the elastic force of the movable contact 24 causes it to move away from and lose contact with the fixed contact 23** thus breaking the electric conduction.

If the printed sections 28 such as numbers, marks or the like, as shown in FIG. 1 are formed on the back surface of the light guiding sheet 31 facing the key switches 25, a displaying window (not shown) which is of a similar shape to that of the printed section 28 and is transparent or formed by punching is provided in each of the key tops 34 facing the printed sections 28. Thereby, the displaying windows can be brightly illuminated by light reflected on the printed sections 28.

It should be noted that provision of printed sections 28 larger than the transparent portions or punched portions formed in the key tops 34 make it possible to achieve more even emission display of the numbers, marks or the like in the key tops 34.

As mentioned above, because the light guiding sheet 31 constituting the sheet switch module 21 according to the present invention is formed by a thin silicone sheet having light guiding properties and flexibility, it can naturally be mounted on the circuit board 22 fitting over and following the concave and convex shapes of the key switches 25 without making a completely close fit with the key switches 25. Consequently, light entering the end portion of the light guiding sheet 31 can be guided smoothly and evenly along the outer surface of each of the key switches 25 in its entirety. In particular, it is possible to brightly illuminate the entire light guiding sheet 31 especially portions of the light guiding sheet in contact with the key switches. Moreover, because the light guiding sheet 31 is thinned and has flexibility, there is no loss of the clicking sensation in the movable contacts 24. Therefore, the switching characteristic is enhanced. Furthermore, because the silicone sheet can be formed to have a thickness of 1 mm or less, the entire sheet switch module can be further thinned.

Although the preferred embodiments of the present invention have been mentioned, the present invention is not limited to these embodiments, and various modifications and changes can be made to the embodiments.

What is claimed is:

1. A sheet switch module, comprising:

a circuit board;

at least one key switch disposed on the circuit board; and a flexible light guiding sheet which is disposed on the key switch and configured to cover an upper surface of the circuit board, wherein the key switch has a fixed contact formed on the circuit board and a semi-spherical movable contact disposed to entirely cover above the fixed contact, and wherein the light guiding sheet is disposed to flexibly fit over and follow along an outer surface of the semi-spherical movable contact, when the light guiding sheet is disposed on the circuit board.

2. The sheet switch module according to claim 1, wherein a plurality of key switches are provided on the circuit board.

3. The sheet switch module according to claim 2, wherein the light guiding sheet is disposed to be in contact with the plurality of key switches.

4. The sheet switch module according to claim 2, wherein, when the light guiding sheet is disposed on the whole of the plurality of key switches, a clearance is provided between the light guiding sheet and the circuit board around a fringe of each of the key switches.

5. The sheet switch module according to claim 1, wherein the light guiding sheet is formed by a thinned silicone sheet having flexibility.

6. The sheet switch module according to claim 1, wherein the movable contact is covered by a fixing sheet to position the movable contact on the circuit board, and the light guiding sheet is disposed on the fixing sheet.

7. The sheet switch module according to claim 1, further comprising at least one side emission-type light emitting diode disposed to face an incident surface of the light guiding sheet, wherein an emission surface of the light emitting diode is set to be at a position lower than the incident surface of the light guiding sheet.

8. The sheet switch module according to claim 7, wherein the light emitting diode includes an element substrate, a light emitting element mounted on the element substrate and a sealing resin to seal the light emitting element, wherein when the light emitting diode is mounted on the circuit board, a mounting position of the light emitting element on the element substrate being set to be lower than a height of the incident surface of the light guiding sheet.

9. The sheet switch module according to claim 1, wherein at least one printed section is provided on the light guiding sheet at a corresponding position facing the key switch.

10. The sheet switch module according to claim 9, wherein the printed section comprises at least one kind of light diffusing agent.

11. The sheet switch module according to claim 9, wherein the printed section is disposed in the light guiding sheet.

12. The sheet switch module according to claim 10, wherein the light diffusing agent is a filler comprising one of titanic oxide, silicon dioxide, and aluminum oxide.

13. A sheet switch module, comprising:

a circuit board;

at least one key switch disposed on the circuit board;

a fixing sheet disposed on the circuit board and the key switch; and a flexible light guiding sheet disposed on the fixing sheet, wherein the key switch has a fixed contact formed on the circuit board and a semi-spherical movable contact disposed to cover above the fixed contact, and wherein the light guiding sheet is disposed on an upper surface of the fixing sheet to flexibly fit over and follow a shape of an outer surface of the semi-spherical movable contact on the circuit board, so that the fixing sheet reflects a light guided through the light guiding sheet at a position of the semi-spherical movable contact.

* * * * *